United States Patent [19]

Roepke et al.

[11] 4,062,595

[45] Dec. 13, 1977

[54] AUTOMATIC FACE TRANSFER LINEAR CUTTING ROTARY HEAD CONTINUOUS MINING MACHINE AND METHOD

[75] Inventors: Wallace W. Roepke, Excelsior; David P. Lindroth, Apple Valley; Richard J. Wilson, Minneapolis, all of Minn.

[73] Assignee: The United States of America as represented by the Secretary of the Interior, Washington, D.C.

[21] Appl. No.: 732,676

[22] Filed: Oct. 15, 1976

[51] Int. Cl.[2] ..... E21C 27/24; E21C 35/20

[52] U.S. Cl. ..... 299/18; 299/64; 299/89

[58] Field of Search ..... 299/18, 64–67

[56] References Cited

U.S. PATENT DOCUMENTS 3,614,162 10/1971 Teeter ..... 299/67

FOREIGN PATENT DOCUMENTS 501,703 7/1930 Germany ..... 299/64

928,941 6/1955 Germany ..... 299/64

*Primary Examiner*—Ernest R. Purser

*Attorney, Agent, or Firm*—Thomas Zack; Donald A. Gardiner

[57] ABSTRACT

A coal mining apparatus and its method of use in which a continuous mining machine removes and transfers cut material reducing airborne respirable coal dust generated in the cutting and collection process. The conventional high speed head rotating with the bits going forward at the top is replaced by a triangular shaped dished out linear cutting head rotating with the bits mounted at the apexes going rearward at the top. This produces a box cut in the mine face with a square cross-section. After the head has made a box cut by sumping the full head diameter beginning at the mine floor, it is sheared upwardly producing a linear shear cut. This shear step is at a constant depth equal to the complete cutting head diameter. The modified cutting head is used as part of the loading and transfer mechanism. This is accomplished by reversing its direction of rotation and cutting on the upstroke from floor to roof so that the head acts as a bucket collecting the cut coal, then transferred to an adjacent transport system which allows the cut coal to be loaded and conveyed away from the mine face without further dust generation due to free fall fracture on the floor or intermediate handling by a dust generating gathering head mechanism. To insure that the coal is consistently discharged at the proper position, a movable bridge conveyor and follower assembly is used with the cutting head.

13 Claims, 3 Drawing Figures

AUTOMATIC FACE TRANSFER LINEAR CUTTING ROTARY HEAD CONTINUOUS MINING MACHINE AND METHOD

BACKGROUND OF THE INVENTION

1. Field of the Invention

This invention is a continuous mining machine which allows coal to be cut from the mine face and transported therefrom while at the same time greatly reducing primary and secondary generation of airborne respirable dust in the process.

2. Description of the Prior Art

Two copending U.S. patent applications commonly assigned to the United States Government constitute the best known prior art relating to this invention. These include the application bearing Ser. No. 604,566, filed Aug. 14, 1975, entitled "Method of Operating a Constant Depth Linear Cutting Head on a Retrofitted Continuous Mining Machine," now U.S. Pat. No. 4,025,116 by W. W. Roepke et al (hereinafter referred to as Method of Linear Cutting); and the application bearing Serial No. 702,373, filed July 2, 1976, entitled "Linear Cutting Rotary Head Continous Mining," now U.S. Pat. No. 4,012,077 By W. W. Roepke et al (hereinafter referred to as a Linear Cutting Rotary Head). The essential difference between this invention and what these two inventions disclose is the method of operation of the rotary head and its associated transport system. Thus, the invention disclosed in the Linear Cutting Rotary Head disclosure has been modified by this invention to allow it to be used to accomplish the Method of Linear Cutting plus a loading and transporting function has been added which at the same time reduces secondary airborne respirable dust generation.

SUMMARY OF THE INVENTION

To practice the method taught by our invention, a continuous mining machine has a retrofitted rotary head which is shaped in cross-section like a dished out Reuleaux or equilateral triangle. Connected thereto is at least one bridge conveyor. Initially, the machine is positioned near the mine working face. Beginning near the mine floor face with its head rotating, the head is then sumped in the face untl the head's full diameter is reached. By rotating the head in the upstroke direction, the cut materials are projected upward and over it. Apparatus is provided to load and transport the cut materials from the mine face by a bridge conveyor and follower assembly located immediately behind the cutting head's discharge and near the front end of an attached boom support. After sumping takes place, the mine face is sheared its total height at constant depth the same depth as sumped by raising the cutting head.

The apparatus to practice the invention has a rotatable cutting head which is shaped in cross-section like a dished out equilateral triangle. This head is movably attached to a bridge conveyor. The head and its bridge conveyor move together due to the follower assembly so that when the head as a unit is moved forward or up its conveyor maintains the same relative position with respect to it. Gathering arms below the bridge conveyor may be combined with it to feed cut material to a rearwardly located main conveyor.

The primary object of this invention is an improved method and apparatus for use with a continuous mining machine having a linear cutting rotary head.

One of the most persistent problems encountered in mining operations, especially coal mining operations, employing machines to cut the material to be mined is that of maintaining or increasing production while at the same time reducing the generation of airborne respirable dust. The mentioned invention entitled Method of Linear Cutting discusses this problem in detail and points out one proposed solution wherein the amount of respirable dust generated is substantially reduced without sacrificing production. However, to achieve the same desired amount of dust reduction and increase production, a cutting head with a rotary motion to achieve a linear cut was proposed and described in the previously referenced Linear Cutting Rotary Head patent application. This type of linear cutting action with a rotating cutting head may be achieved by using a head which is configured like a Realeaux triangle or an equilateral triangle in cross-section. Specific details on this type of cutting head and a drive mechanism to allow it to make box cuts are found in the mentioned Linear Cutting Rotary Head patent application. The subject matter pf these two background inventions will not be repeated herein but is specifically incorporated herein by reference. It is necessary to understand their basic principles and the proposed solutions to the problems presented to fully understand this invention. Briefly, this invention takes the Linear Cutting Rotary Head and modifies its method of operation and structure. It does this by utilizing the sump and shear cycle of the Method of Linear Cutting in which the cutting head is first sumped into the mine face near the mine floor and then sheared at a constant depth to the roof with the cutting head rotating in reverse to the direction described in the Linear Cutting Rotary Head patent application and modified in such a manner as to automatically collect and transport the cut coal in buckets designed into the cutting head.

Broken coal freely falling from the place where cut causes large amounts of secondary dust generation as does the typical gathering arm mechanism for a continuous mining machine (CMM). To further reduce airborne respirable dust generation, the secondary dust generation is controlled at the face by this new cutterhead design in association with a new handling and transportation system as proposed which eliminates the major portion of the free falling cut coal.

Figure 1:
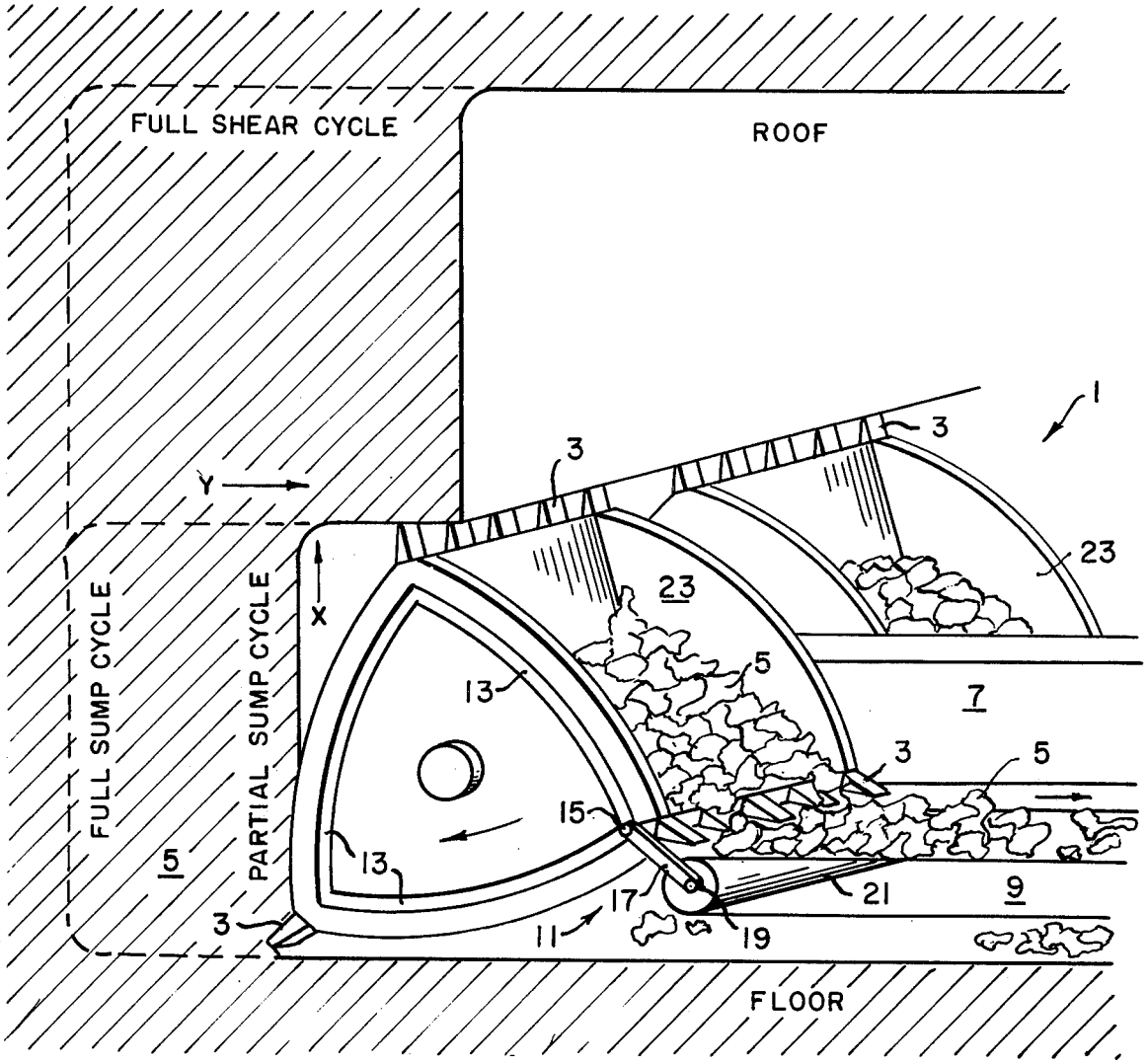
FIG. 1 is a isometric view of the front end of the preferred embodiment at mine face after a partial sump cycle has taken place.

The cross-sectional view of the working mine face illustrated in FIG. 1 schematically shows how the face would look after a partial sump cycle. As viewed, the dished out equilateral triangle shaped cutting head rotates in a clockwise direction and has sumped part of its full sump cycle. The unique combination of the shape of the cutting head and internal gearing in its attached boom allows it to make a box cut with slightly rounded corners as more fully discussed in the Linear Cutting Rotary Head patent application. With such a box cut at the mine face, it has long been a problem to find a suitable drive train. We have solved this drive train problem and it is this type of drive train or any similar combination of component parts giving the same path to the apexes which we contemplate would be used to rotate the cutting head of our invention. Since the cutting head in this invention is shaped in cross-section like an equilateral triangle such that its configuration follows the path described by Reuleaux, as disclosed in FIGS. 1 and 5 of the copending Linear Cutting Rotary Head patent application, it will cut out a square vertical face in cross-section or box-cut in volume when its full sump cycle has been completed. FIG. 1 shows a side view of this square cut out section in dotted line format. One type of drive gear train that could be used in the front end of the boom to rotate the triangular shaped cutting head and achieve the desired square hole cut is described in the commonly assigned copending U.S. patent application having Ser. No. 705,361, filed on July 14, 1976, by Roger J. Morrell et al entitled Square Hole Drill.

After the full sump cycle is completed the entire depth of the cutting head, the shear cycle begins. In accordance with the principles of the method described in the patent application on the Method of Linear Cutting, this shearing is accomplished, at a constant depth, without removing the cutting head from its full sumped depth, from the mine floor to mine roof. This linear cut during the sumping step is perpendicular to the bedding (direction X in FIG. 1) making up the coal seam while the linear cut during shear is parallel to the bedding shown by the Y arrow in FIG. 1. The clockwise rotation of the triangular shaped cutting head 1 as shown in FIG. 1 causes its cutting bits 3 to dislodge the coal 5 from the mine face and transport it over the head and past the side of the support boom 7 until it is deposited on the adjacent power driven attached bridge conveyor belt 9. The number of bits extending for the apexes of each of the two triangular heads is determined by the depth of cut desired. Usually the spacing between adjacent bits is 2 to 3 times the depth of cut desired with fewer bits being used for deeper cuts in the coal. The elongated boom extends in the same direction as the bridge conveyors and is located between them. In order to insure that the material being discharged from the cutting head lands on the bridge conveyors, a follower mechanism 11 is employed. Essentially this mechanism causes the bridge conveyors to follow their cutting head so that they always remain in substantially the same relative position with respect thereto. It is made up of a triangular shaped track 13 recessed in the side of the head, a roller 15 which freely rolls in this track of the head, a link arm 11 connected to the track roller at one end, a pivot connection 19 at the other end, and an elongated roller 21 with a tapered center portion which rides under the end of conveyor 9. The conventional power source to drive the bridge conveyors is now shown. Dished out recessed portions 23 of the head allow for collection of the fragmented coal during cutting operations. Once the cutterhead 1, support boom 7, and the follower mechanism 11 have advanced to their full sump cycle cut — to the left in FIG. 1 — the support boom is used to raise the rotating cutting head thereby beginning the shear cycle. When the full sump and shear cycles have been completed, each of the cutterheads (preferably two separate aligned ones with the boom between as shown in the figures) will have made a box cut from the floor to roof the depth of the sumped head.

Figure 2:
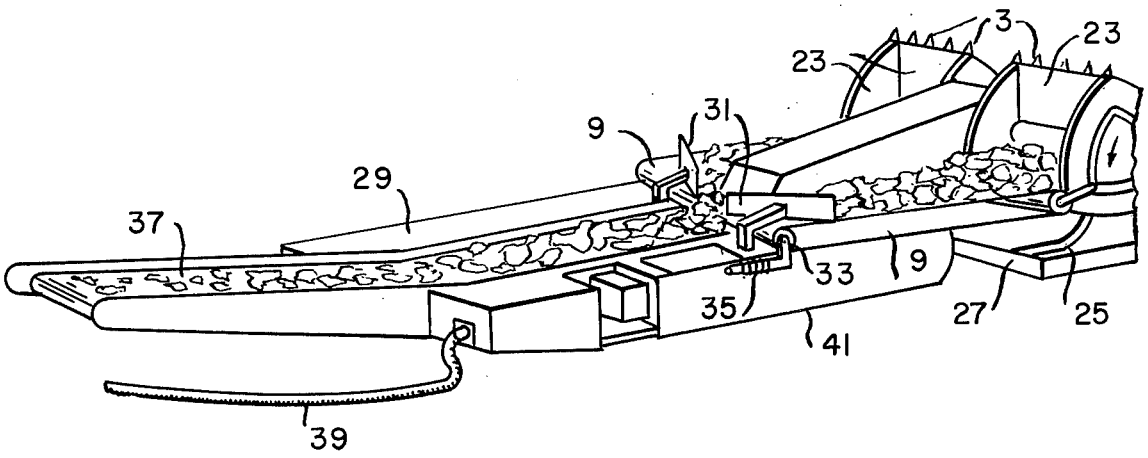
FIG. 2 and FIG. 3 are pictorial views showing a conventional continuous mining machine as modified by incorporating the preferred embodiment of our invention therein.
Figure 3:
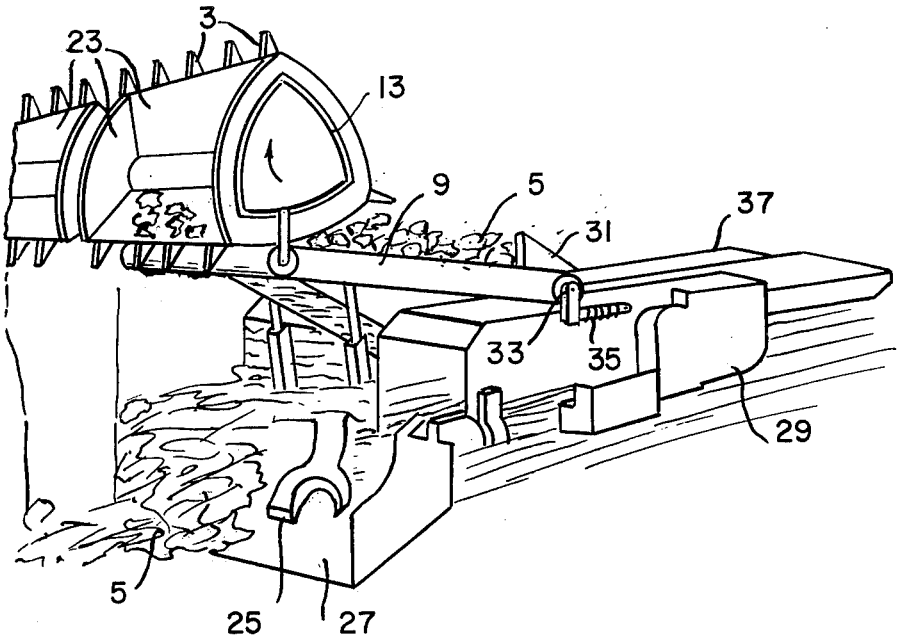

Not only may the equilateral triangle cutting head be used with the modifications indicated and in the way described to reduce primary respirable generation during cutting, but the head assembly could be further modified as shown in FIGS. 2 and 3 to further reduce secondary dust generation produced by falling coal and excessive gathering arm handling. Essentially, the modifications consist of adding a transportation system to the cutterhead. As is described and shown in FIGS. 2 and 3, a follower mechanism 11 mechanically links the bridge conveyors directly to the cutter head to impose an oscillatory motion on the bridge conveyors in synchronization with the rotation of the cutting heads. Guides in each of the head recess sections funnel the fragmented collected coal to the center of the head before they are dumped into the rearward bridge conveyors. The cutterhead is revolving in a direction opposite to that described in the Linear Cutting Rotary Head invention so that it cuts on the upstroke instead of the down stroke. In this way it gathers the coal cut from the seam in the cutting head recess 23 and carries it over the top of the cutterhead to the lower rearwardly located bridge conveyor 9. This arrangement reduces further secondary airborne respirable dust generated by free fall fracture on the floor, since the coal gathering and transportation system employs a conventional movable center support boom modified with two bridge conveyors, and a follower mechanism for each conveyor which keeps the conveyors in close proximity to and at the same elevation as the cutting head. Beneath this transportation system is a pair of conventional gathering arms 25 with a base pan 27. These may be utilized as a floor trimming device and to gather minor amounts of coal which have either missed or fallen off the bridge conveyors. Raising the support boom causes its cantilevered attached cutting head to rise vertically. Associated with this raising action is the follower mechanism attached to the CMM 29 at its pivot connections 33 with the two tension springs 35. These springs keep the elastic belts forming the bridge conveyors taut throughout the oscillatory motion of the follower mechanism as it follows the rotation of the cutting head. Near the bridge conveyor's pivot connection are two (FIG. 3) slanted chutes 31 to guide coal from the bridge conveyor belts to the lower rotating main conveyor belt system 37. A second roller 43 tapered at its center can also be used at the conveyor's other end to cradle the mined material. Thus, immediately after the coal is cut by bits 3 it is first guided by guides into dished out cutter head cavities 23 and momentarily cradled there until deposited on the inclined bridge conveyor. Thereafter, chutes 31 direct the coal to the underlying moving main conveyor 37 and away from the mine working area. Should any small fragments fall off the conveyor or miss it entirely they too will be gathered in by arms 25 and fed via their pan and then to the main conveyor.

Our invention can be seen to consist of modifications to the conventional rotary head continuous mining machine with additional material handling and transportation devices. The main conveyor belt 37 is used to convey the mined material to a shuttle car for removal from the mine face. The other parts of the system, including those used to propel the CMM and boom, may be conventional. These would include electric and/or hydraulic motors for the CMM and boom. For example, the CCM could be any electrically operated (via cable 39) conventional drum type miner with a high speed head like Model 12 CM manufactured by the Joy Manufacturing Company of Pittsburgh, Pa. Either DC or AC current may be used to power this machine on its tracks 41 to operate it as described.

The stated objective of our invention is to reduce dust generated at the mine face, especially primary and secondary airborne respirable coal dust, produced by the cutting and gathering mechanism while increasing production potential. It has accomplished this objective by using a new linear cutting rotary head which cuts at a deep constant depth with low rpm. The particular method selected to reduce airborne respirable dust is based on both experimental and theoretical analysis. From these sources we have concluded that:

1. Both specific airborne respirable dust and specific nonairborne respirable dust are monotonically increasing functions of specific energy.
2. Specific dust and specific energy are inversely proportional to the depth of cut.
3. An optimum value for the space to depth ratio of the cutting bits exist between 2 and 3 for linear cutting.
4. Conventional rotary cutting has an inherent bit spacing problem since the correct bit spacing is only obtained at maximum depth for each bit.
5. Conventional rotary cutting has an inherently poor, low volume recovery in the first 60 percent of advance distance for each bit on the rotary head drum making this portion of the rotary cut highly inefficient with abnormal amounts of dust.
6. Specific airborne respirable dust generated from the rotary cut is greater than that generated from the linear cut.
7. Conventional rotary cutting does not permit an optimum bit angle to be defined since the bit attack angle varies constantly during cutting.

From these conclusions we have determined that an ideal continuous mining machine should incorporate a rotary head for high productivity using only deep linear cuts to reduce primary dust generation to a minimum with an automatic collection device for the cut coal or other material which would reduce secondary dust generation caused by impact on the floor or by action of a gathering head mechanism. As described herein our invention accomplishes all of these desired results.

One alternative embodiment of our invention would substitute a power takeoff from the main drive shaft with a single mechanical linkage in place of the follower mechanism. When this is done, oscillatory motion is provided to the bridge conveyors to allow it to be in the proper position to receive the discharged coal.

Another embodiment would use a flat plate extender beyond the end of the bridge conveyor as a collector for any material falling between the cutterhead and conveyor. By appropriate power means, e.g., hydraulic conveyors or a power takeoff from the main drive shaft, the flat plate may be dumped into a conveyor. Raising means could be employed to maintain the plate at an angle during the times it is not being raised to dump the collected coal or being forced down to allow the cutterhead to pass. The half-raised position better facilitates collection of the falling out material and improves the efficiency of the conveyor system by maintaining the collected coal in close contact with the main conveyor belt.

It is a characteristic feature of our invention that it will make deeper cuts than most presently operating continuous mining machines. As such, we estimate coal production can be increased from 10 to 20 tons for each minute of operation as the cutting head is slowly rotating at 6 to 10 revolutions per minute. Coupled with this increase in production will be the reduction of airborne respirable dust generated by more than 95 percent from that generated by presently used conventional CCMs. When this happens, methane ignition caused by frictional heat at the coal mine face is also dramatically reduced.

Although our invention was designed to operate mainly in coal mines to reduce the generation of airborne respirable dust at the mine face with increased production, its principles can be applied to any other type of mining operation where the same objectives are desired. None of the stated details describing coal mining operations or any other features should be used to limit the scope and spirit of our invention which is to be measured only by the claims which follow.

We claim:

1. A continuous mining machine assembly comprising:

a main machine body for moving said assemble with respect to a mine face;

a vertically movable support boom connected to said machine body near its front end;

a rotatable cutting head operatively mounted on said boom near the end opposite to where it is connected to said body and movable vertically therewith, said head having a body whose outer cross-sectional configuration resembles an equilateral triangle with at least one cutting bit at each apex, said head also having material retaining recesses;

a bridge conveyor movably mounted at its ends extending and movable in the same direction as said boom for receiving cut mined material discharged from the head and transporting said same material away from the mine face;

and follower means connecting said bridge conveyor to said cutting head for causing said bridge conveyor to follow the rotation of said rotating head and to remain in substantially the same material receiving relative position with respect thereto.

2. The assembly of claim 1 wherein said cutting head comprises:

at least one cutting bit extending from each of the apexes of the equilateral triangle body and said material retaining means is formed by recesses within the body forming the sides of the equilateral triangle for momentarily retaining cut material therein during at least part of the head's rotational cycle.

3. The assembly of claim 2 also including means for rotating said head in the boom which upon rotation of said cutting head causes its bits to transverse a generally square trajectory when viewed in the same cross-sectional direction as the head's equilateral triangle.

4. The assembly of claim 1 wherein:

said follower means comprises a track mounted on said head and a freely mounted track follower extending therefrom towards said bridge conveyor.

5. The assembly of claim 4 wherein said track follower is pivotally mounted to a roller which is operatively associated with the bridge conveyor.

6. The assembly of claim 1 wherein said bridge conveyor is a movable elastic belt, and also including biasing and pivoting means attached to the bridge conveyor at its end remote from said head to keep the bridge conveyor belt taut and to allow said conveyor to be moved in a vertical direction.

7. The assembly of claim 1 also including a material gathering pan attached to the lower front end of said machine body;

material gathering arms within said pan to convey materials deposited therein away from the mine face; and a main conveyor system operatively associated with the discharges from said bridge conveyor and material gathering arms to move material further away from the mine working area.

8. The assembly of claim 1 also including a second identical bridge conveyor with its own associated second cutting head disposed on the opposite side of the support boom; and material directing means to guide the discharges from the bridges conveyors to a common output.

9. A method of mining material with a continuous mining machine having a rotatable cutting head whose cross-sectional configuration resembles a Reuleaux triangle comprising the steps of:

sumping said head while it is rotating into the mine face beginning near the mine floor to cut out a box cut therein when viewed in cross-section; and after sumping said head substantially its entire depth, shearing the mine face in an upward direction substantially the same depth as sumped, without removing the head, up to the mine roof.

10. The method of claim 9 wherein said sumping step takes place in a generally horizontal plane to produce deep linear cuts which are perpendicular to the bedding planes as said cutting head cutters cut on the up stroke at the mine face; and said shearing step takes place in a generally vertical plane to produce deep linear cuts parallel to the bedding planes as said linear cutting head at its upper side rotates towards said continuous mining machine.

11. The method of claim 9 also including the additional steps of transporting the cut material away from the mine face by a movable conveyor located adjacent the discharge from the cutting head; and oscillating the front end of the conveyor so that it follows the rotation of the cutting head to remain substantially at the same discharge area therefrom.

12. The method of claim 11 also including the step of collecting the cut material in the cutter head on the cutting head's upstroke and retaining it there before transporting it to the conveyor located downward of the head.

13. The method of claim 11 including the step of guiding said deposited cut material from the discharge end of the movable conveyor to a main mine conveyor system.

* * * * *